United States Patent [19]

Suzuki et al.

[11] 4,382,489

[45] May 10, 1983

[54] APPARATUS FOR OPERATING DURING EARTHQUAKE

[75] Inventors: Katsuhiko Suzuki; Shinobu Tajima, both of Inazawa, Japan

[73] Assignee: Mitsubishi Denki Kabushiki Kaisha, Tokyo, Japan

[21] Appl. No.: 293,237

[22] Filed: Aug. 17, 1981

Related U.S. Application Data

[63] Continuation of Ser. No. 116,470, Jan. 29, 1980, abandoned.

[30] Foreign Application Priority Data

Feb. 8, 1979 [JP] Japan ..... 54-13639

[51] Int. Cl.[3] ..... B66B 13/24

[52] U.S. Cl. ..... 187/29 R

[58] Field of Search ..... 187/1 R, 29 R, 32, 33

[56] References Cited

U.S. PATENT DOCUMENTS

| | | | |
|---|---|---|---|
| 3,561,569 | 2/1971 | Suozzo et al. | 187/29 |
| 3,792,759 | 2/1974 | Kirsch | 187/29 |
| 3,896,906 | 7/1975 | Shrum | 187/29 |
| 4,069,898 | 1/1978 | Tosato et al. | 187/29 |

*Primary Examiner*—J. V. Truhe
*Assistant Examiner*—W. E. Duncanson, Jr.
*Attorney, Agent, or Firm*—Oblon, Fisher, Spivak, McClelland & Maier

[57] ABSTRACT

An apparatus for operating during earthquake which should be stopped to prevent an accident by detecting earthquake is provided. The apparatus detects an initial slight earthquake shock to perform a preliminary operation for earthquake by a first control device. When higher vibration is not detected within a specific time, the apparatus is reset. When high vibration is detected, an operation for earthquake including the stop of the apparatus is performed by a second control device.

1 Claim, 2 Drawing Figures

APPARATUS FOR OPERATING DURING EARTHQUAKE

This is a continuation of application Ser. No. 116,470, filed Jan. 29, 1980, now abandoned.

BACKGROUND OF THE INVENTION

1. Field of the Invention

The present invention relates to an apparatus which detects earthquake and stops the operation so as to prevent an accident. More particularly, it relates to an apparatus for operating an elevator during an earthquake.

2. Description of the Prior Art

A conventional apparatus which detects an earthquake in order to prevent an accident such as a conventional apparatus for operating an elevator during earthquake will be described.

It has been proposed to operate an elevator system which detects an earthquake and drives a cage to a nearby floor and opens its door and then, stops the operation. In such an operation for earthquake, it is preferable to detect an initial slight earthquake shock so as to switch the operation to the operation for earthquake and to stop the cage and to allow passengers to escape from the cage of the elevator before the main earthquake shock.

The device for detecting the initial slight earthquake shock is actuated, however, by even a weak earthquake which does not cause any damage to the elevator or a vibration caused by a construction near the building. Thus, needless operations of the elevator system in earthquake are disadvantageously often caused to prevent the normal operation of the elevator system.

SUMMARY OF THE INVENTION

The present invention is to overcome the prior art disadvantages and to provide an apparatus for operation during an earthquake which operates only for an important time without losing a function of the apparatus such as an elevator for a long period by a weak earthquake or any other shock, but operates without any failure during a strong earthquake preventing damage of any apparatus such as the elevator system.

DETAILED DESCRIPTION OF THE PREFERRED EMBODIMENTS

Figure 1:
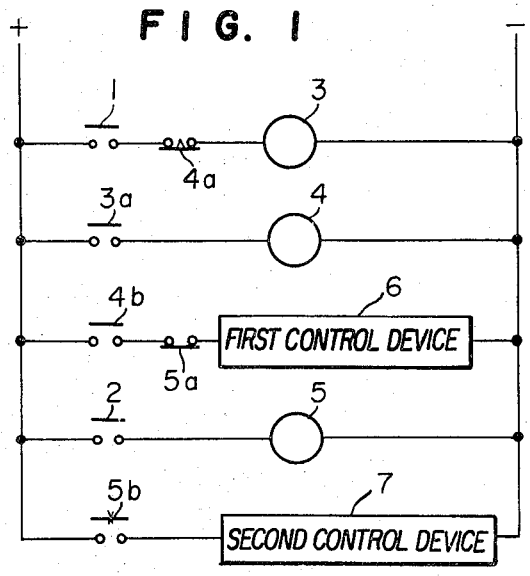
FIG. 1 is a circuit diagram of one embodiment of the apparatus for operating the elevator during earthquake.

Referring to the Drawings, one embodiment of the apparatus for operating the elevator during earthquake will be described.

In FIG. 1, the reference numeral (1) designates a first detector which is actuated by a relatively slight specific vibration such as the initial slight earthquake shock; this may be vertical vibration sensor which is actuated by vertical vibration of earthquake; (2) designates a second detector which is actuated by a stronger vibration such as a horizontal vibration sensor which is actuated by horizontal vibration of earthquake; (3) designates a first detecting relay; (3*a*) designates a normally opening contact; (4) designates an auxiliary relay; (4*a*) designates a timing device having a normally closing contact for the timing operation of the auxiliary relay; (4*b*) designates a normally opening contact of the auxiliary relay (4); (5) designates a second detecting relay; (5*a*) designates a normally closing contact of the relay; (5*b*) designates a normally opening contact for manual reset; (6) designates a first control device which operates the preliminary operations in earthquake such as a temporary stop of the cage on the nearest floor; a slow speed operation; an operation for every floor stopping; or a door-opening wait operation for a specific time after reaching to the nearest floor; (7) designates a second control device which stops the cage on the nearest floor and opens the door and stops further operation and is not automatically reset; and (+), (−) designate a power source.

Figure 2:
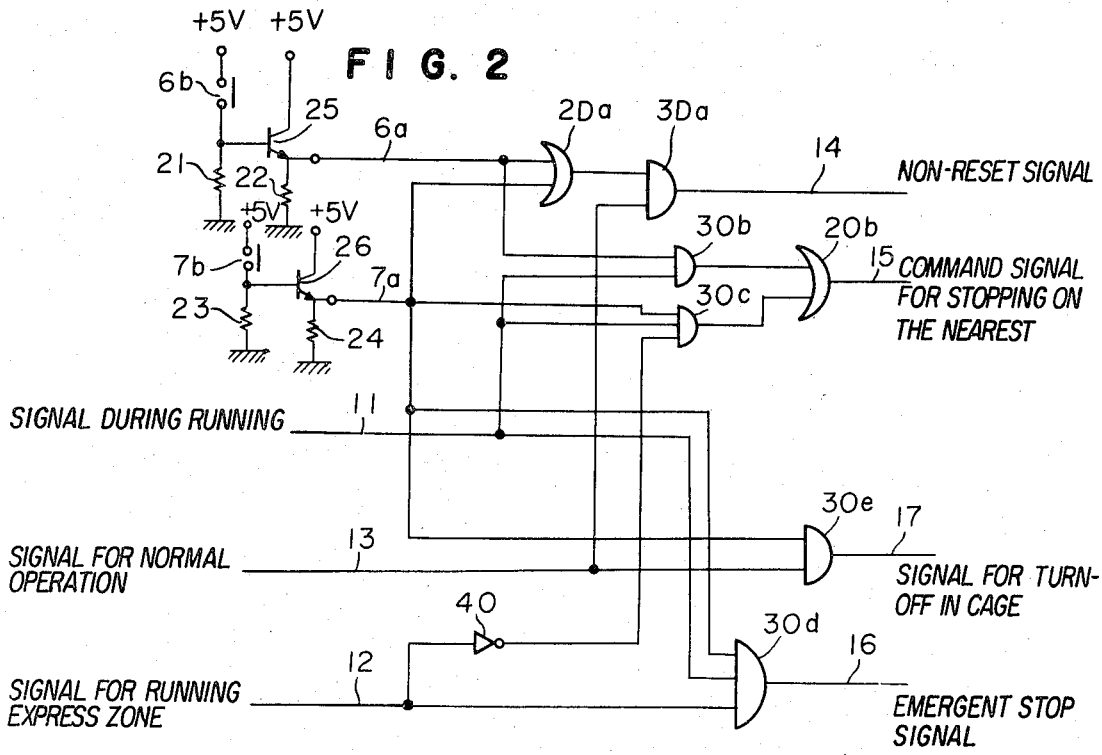
FIG. 2 is a circuit diagram of one embodiment of a first control device and a second control device of the embodiment of FIG. 1.

Referring to FIG. 2, the first control device (6) and the second control device (7) will be described in detail.

The reference numeral (6*b*) designates a normally opening contact of a first control command relay connected to the first control device (6) of FIG. 1; (6*a*) designates a first control command signal which is increased to high level when the first control command relay is actuated to close the normally opening contact (6*b*); (7*b*) designates a normally opening contact of the second control command relay connected to the second control device (7) of FIG. 1; (7*a*) designates a second control command signal which is increased to high level when the second control command relay is actuated to close the normally opening contact (7*b*); (11) designates a signal which is in high level during the running of the cage; and is changed in low level by stopping the cage; (12) designates a signal indicating the driving in the non-stop floors as express-non-stop zone and the signal is in high level during driving through the express-non-stop zone; (13) designates a signal which is in high level at the time of normal landing and stopping; (14) designates a non-reset signal (a restart of a cage is prevented by the signal); (15) designates a command signal for stopping on the nearest floor; (16) designates an emergent stop signals; (17) designates a signal for turn-off in the cage; (21),(22),(23) and (24) respectively designate resistance elements; (25) and (26) designate a transistor element; (20*a*) and (20*b*) respectively designate an OR element which outputs high level when only one of the input signal is in high level; (30*a*)–(30*e*) respectively AND elements which output high level only when all input is in high level; and (40) designates an NOT element which reverse the input.

When the first detector (1) is actuated to close the contact by the initial slight earthquake shock; such as the vertical vibration, the first detecting relay (3) is actuated to close the contact (3*a*) by the closed circuit of (+)-(4*a*)-(3)-(−). Therefore, the auxiliary relay (4) is actuated by the closed circuit of (+)-(3*a*)-(4)-(−) and the timing device (4*a*) is opened after the specific timing and the contact (4*b*) is closed. Thus, the first control device (6) is actuated by the circuit of (+)-(4*b*)-(5*a*)-(6)-(−) to perform the preliminary operation for earthquake.

When the first control command relay is actuated to close the normally opening contact (6*b*) and the first control command signal becomes in high level and the cage is running in high level of the signal (11), a nearest floor landing signal (15) is transmitted through an AND device (30*b*) and an OR device (20*b*) to land the cage on the nearest floor. In such condition, when the earthquake is too weak to have the main vibration reaching the minimum level of the second detector (2) or the operation of the first detector (1) is caused by another vibration beside the earthquake, the timing device (4*a*) is released after the specific timing, whereby the first detecting relay (3) is deactuated to open the contact (3*a*) and the auxiliary relay (4) is deactuated to open the contact (4*b*) and the first control device (6) is deactuated. Therefore, the elevator system is returned to the normal operation. The disadvantage of needless stopping of the operation of the elevator system can be overcome.

When the earthquake is strong and the second detector (2) is actuated by the main vibration within the timing of the timing device (4*a*) after the initial slight earthquake shock, the second detecting relay (5) is actuated by the circuit of (+)-(2)-(5)-(−) to open the contact (5*a*) and to close the contact (5*b*). Therefore, the first control device (6) is deactuated by opening the contact (5*a*) and the second control device (7) is actuated by the circuit of (+)-(5*b*)-(7)-(−), whereby the operation for earthquake such as the stopping of the elevator system is performed.

Thus, the second control command relay is actuated to close the normally opening contact (7*b*) and the second control command signal (7*a*) becomes in high level. When the cage is running (the signal (11) is high level) and is not running in the non-stop zone (the signal (12) is in low level), the nearest floor landing command (15) is applied through the AND device (30*c*) and the OR device (20*b*) to land the cage on the nearest floor. When the cage is running in the non-stop zone (the signal (12) is in high level), an emergency stop signal (16) is applied through the AND device (30*d*) to stop the cage in emergency. When the cage is normally landed on the floor to stop (the signal (13) is in high), a non-reset signal (14) is applied through the OR device (20*b*) and the AND device (30*a*) whereby the reset of the cage is automatically prevented.

When the second control command signal (7*a*) is in high level and the cage is normally landed to stop (the signal (13) is in high level) or the cage is normally landed on the nearest floor (the signal (13) is in high level) by the nearest floor landing command signal (15) after changing the second control command signal (7*a*) in high level, a signal for turn-off in the cage (17) is applied through the AND device (30*e*) to turn off the lamp in the cage and to allow passengers to escape from the cage.

Thus, in the apparatus for operating during the earthquake, the preliminary operation for earthquake is performed by the vibration which does not cause any damage to the elevator system whereby the function of the elevator system is not lost for a long time.

When any damage of the elevator system is considered in the earthquake, the operation for earthquake is performed after the preliminary operation for earthquake. Therefore, it provides the elevator system operating for earthquake capable of allowing passengers to escape in the early stage.

In said embodiment, the apparatus for operating during earthquake is applied to the elevator system. The similar effect can be expected by applying the apparatus for operating during earthquake to another apparatus which should prevent an accident by detecting earthquake such as an electric power feeding system, a gas supplying system, a traffic system, etc.

The initial slight earthquake shock can be detected in high accuracy by using the first detector (1) which is actuated by vertical earthquake vibration in said embodiment.

A desired operation is obtained by setting the specific timing of the timing device (4*a*) to about 20 seconds from the viewpoint of characteristics of earthquake.

The vibration for the operation of the second detector (2) should be set corresponding to the minimum of the main vibration of earthquake causing any damage to the elevator system.

As described above, in accordance with the present invention, the apparatus for operating during earthquake such as the elevator system is operated in the preliminary operation for earthquake by the first control device by detecting the initial slight earthquake shock and is operated in the operation for earthquake by the second control device when the main vibration of earthquake is caused following to the initial slight earthquake shock. Therefore, there is provided an apparatus such as the elevator system operating for earthquake detection wherein the function of the apparatus such as the elevator system is not lost only by weak earthquake or the other vibration whereas the operation for earthquake is performed without failure during an earthquake which may cause any damage of the apparatus such as the elevator system.

We claim:

1. In an apparatus for operating an elevator system during an earthquake which comprises a vertical vibration sensor which is actuated by a specific vibration and a horizontal vibration sensor which is actuated by vibration greater than the vibration for said vertical sensor and including a first control device which performs a preliminary operation on an elevator cage and a second control device which is actuated by the operation of said horizontal sensor to perform the operation for earthquake detection including the stopping of said elevator cage, wherein said elevator system has an output means to indicate the normal operation of said system and the express operation of said system to detect whether said elevator stops at each specified level or whether said elevator is operating in an express zone, the improvement comprising:

a logic means responsive to said first and second control devices and said elevator system output means to provide a control stoppage of said elevator cage dependent upon the condition of said first and second control devices and said operating signals from said elevator system whereby when said output means indicates the normal operation of said system said elevator cage is stopped at the next floor and when said output means indicates the express operation of said system said elevator cage is immediately stopped without regard to its location.

* * * * *